US005127053A

United States Patent [19]

Koch

[11] Patent Number: 5,127,053

[45] Date of Patent: Jun. 30, 1992

[54] LOW-COMPLEXITY METHOD FOR IMPROVING THE PERFORMANCE OF AUTOCORRELATION-BASED PITCH DETECTORS

[75] Inventor: Steven R. Koch, Waterford, N.Y.

[73] Assignee: General Electric Company, Schenectady, N.Y.

[21] Appl. No.: 632,552

[22] Filed: Dec. 24, 1990

[51] Int. Cl.[5] ..... G10L 5/00

[52] U.S. Cl. ..... 381/31; 381/36

[58] Field of Search ..... 381/31, 36

[56] References Cited

U.S. PATENT DOCUMENTS 4,184,049 1/1980 Crochibne ..... 381/31

4,360,708 11/1982 Taunchi ..... 381/36

OTHER PUBLICATIONS

Fujisaki et al., "A New Ssytem for Reliable Pitch Extraction of Speech", IEEE Proc. of 1987 Int. Conf. on Acoustics, Speech and Signal Processing, pp. 2422-2424.

Picone et al., "Robust Pitch Detection in a Noisy Telephone Environment", IEEE Proc. of 1987 Int. Conf. on Acoustics, Speech and Signal Processing, pp. 1442-1445.

*Primary Examiner*—Emanuel S. Kemeny

*Attorney, Agent, or Firm*—Marvin Snyder; James C. Davis, Jr.

[57] ABSTRACT

A method of operating an autocorrelation pitch detector for use in a vocoder overcomes the pitch doubling and tripling problem using a heuristic rather than an analytic approach. The process tracks the times of occurrence of a highest and a second-highest autocorrelation peak. The amplitudes of the highest and the second-highest autocorrelation peaks are compared and, when these peaks are within a predetermined percentage difference in amplitude, the ratio of the time position (IPITCH2) of the second-highest peak to the time position (IPITCH) of the highest peak is checked to determine if that ratio is $\frac{1}{3}$, $\frac{1}{2}$ or $\frac{2}{3}$, within a predetermined error limit $\epsilon$. If so and if the ratio is either $\frac{1}{2}$ or $\frac{1}{3}$, then IPITCH is set equal to IPITCH2 as reepresentative of the pitch period while, if the ratio is $\frac{2}{3}$, then IPITCH is divided by three in order to represent the pitch period.

8 Claims, 10 Drawing Sheets

DECODER

LOW-COMPLEXITY METHOD FOR IMPROVING THE PERFORMANCE OF AUTOCORRELATION-BASED PITCH DETECTORS

CROSS-REFERENCE TO RELATED APPLICATION

This application is related in subject matter to the invention disclosed in copending application Ser. No. 07/612,056 filed by R. L. Zinser and S. R. Koch for "Linear Predictive Codeword Excited Synthesizer" on Nov. 13, 1990, and assigned to the assignee of this application. The disclosure of application Ser. No. 07/612,056 is incorporated herein by reference.

BACKGROUND OF THE INVENTION

1. Field of the Invention

This invention generally relates to digital voice transmission systems and, more particularly, to a low complexity method for improving performance of autocorrelation-based pitch detectors for digital voice transmission systems.

2. Description of the Prior Art

Code Excited Linear Prediction (CELP) and Multipulse Linear Predictive Coding (MPLPC) are two of the most promising techniques for low rate speech coding. The current Department of Defense (DoD) standard vocoder is the LPC-10 which employs linear predictive coding (LPC). A description of the standard LPC vocoder is provided by J. D. Markel and A. H. Gray in "A Linear Prediction Vocoder Simulation Based upon the Autocorrelation Method", *IEEE Trans. on Acoustics, Speech, and Signal Processing,* Vol. ASSP-22, No. 2, April 1974, pp. 124–134. While CELP holds the most promise for high quality, its computational requirements can be too great for some systems. MPLPC can be implemented with much less complexity, but it is generally considered to provide lower quality than CELP.

An early CELP speech coder was first described by M. R. Schroeder and B. S. Atal in "Stochastic Coding of Speech Signals at Very Low Bit Rates", *Proc. of* 1984 *IEEE Int. Conf. on Communications,* May 1984, pp. 1610–1613, although a better description can be found in M. R. Schroeder and B. S. Atal, "Code-Excited Linear Prediction (CELP): High-Quality Speech at Very Low Bit Rates", *Proc. of* 1985 *IEEE Int. Conf. on Acoustics, Speech, and Signal Processing,* March 1985, pp. 937–940. The basic technique comprises searching a codebook of randomly distributed excitation vectors for that vector that produces an output sequence (when filtered through pitch and linear predictive coding (LPC) short-term synthesis filters) that is closest to the input sequence. To accomplish this task, all of the candidate excitation vectors in the codebook must be filtered with both the pitch and LPC synthesis filters to produce a candidate output sequence that can then be compared to the input sequence. This makes CELP a very computationally-intensive algorithm, with typical codebooks consisting of 1024 entries, each 40 samples long. In addition, a perceptual error weighting filter is usually employed, which adds to the computational load. A block diagram of an implementation of the CELP algorithm is shown in FIG. 1, and FIG. 2 shows some example waveforms illustrating operation of the CELP method. These figures are described below to better illustrate the CELP system.

Multi-pulse coding was first described by B. S. Atal and J. R. Remde in "A New Model of LPC Excitation for Producing Natural Sounding Speech at Low Bit Rates", *Proc. of* 1982 *IEEE Int. Conf. on Acoustics, Speech, and Signal Processing,* May 1982, pp. 614–617. It was described as improving on the rather synthetic quality of the speech produced by the standard DOD LPC-10 vocoder. The basic method is to employ the LPC speech synthesis filter of the standard vocoder, but to excite the filter with multiple pulses per pitch period, instead of the single pulse used in the DoD standard system. The basic multi-pulse technique is illustrated in FIG. 3, and FIG. 4 shows some example waveforms illustrating the operation of the MPLPC method. These figures are described below to better illustrate the MPLPC system.

Currently, and in the past few years, much attention in speech coding research has been focused on achieving high quality speech at rates down to 4.8 Kbit/sec. The CELP algorithm has probably been the most favored algorithm; however, the CELP algorithm is very complex in terms of computational requirements and would be too expensive to implement in a commercial product any time in the near future. The LPC-10 vocoder is the government standard for speech coding at 2.4 Kbit/sec. This algorithm is relatively simple, but speech quality is only fair, and it does not adapt well to 4.8 Kbit/sec use. There was a need, therefore, for a speech coder which performs significantly better than the LPC-10, and for other, significantly less complex alternatives to CELP, at 4.8 Kbit/sec, rates. This need was met by the linear predictive codeword excited speech synthesizer (LPCES) described and claimed in the aforementioned copending application Ser. No. 07/612,056.

The LPCES vocoder is a close relative of the standard LPC-10 vocoder. The principal difference between the LPC-10 and LPCES vocoders lies in the synthesizer excitation used for voiced speech. The LPCES employs a stored "residual" waveform that is selected from a codebook and used to excite the synthesis filter, instead of the single impulse used in the LPC-10.

In the LPCES vocoder, the voiced excitation codeword exciting the synthesis filter is updated once every frame in synchronism with the output pitch period. This makes determination of the pitch period very important for proper operation of this coder. During development of the LPCES, artifacts in the synthesized speech were traced to errors by the pitch detector. The most bothersome artifacts were found to result from the pitch detector reporting a period that is twice or three times as long as it should be. In general, in pitch-synchronous LPC vocoders, quality of the synthesized speech is highly correlated with accuracy of pitch detection.

Many pitch detection algorithms have been described in the literature, but none have provided 100% accuracy. The problem, like many in speech coding, is a difficult one that does not have a closed-form mathematical solution. Many algorithms which are intended to deliver highly reliable pitch information introduce a level of complexity which it is desirable to avoid. Discussions of recently developed algorithms for pitch detection can be found in J. Picone et al., "Robust Pitch Detection in a Noise Telephone Environment", *IEEE Proc. of* 1987 *Int. Conf. on Acoustics, Speech and Signal*

*Processing*, pp. 1442–1445, and H. Fujisaki et al., "A New System for Reliable Pitch Extraction of Speech", *IEEE Proc. of* 1987 *Int. Conf. on Acoustics. Speech and Signal Processing*, pp. 2422–2424.

SUMMARY OF THE INVENTION

It is, therefore, an object of the present invention to provide a way of avoiding the pitch detection errors that produce artifacts in the output signal of the LPCES coder, specifically the pitch period doubling and tripling problem.

Another object of the invention is to provide a method for overcoming the pitch period doubling and tripling problem in a direct manner with minimal complexity.

The invention overcomes the pitch doubling and tripling problem by using a heuristic rather than analytic approach. The basic pitch detector is mainly a peak-finding algorithm. The LPC residual for a frame of speech data is low pass filtered, and an autocorrelation operation is performed. A search is then made for the highest peak in the autocorrelation function. Its position indicates the pitch period.

It was found through examination that in most cases in which the basic pitch detector failed, peaks in the autocorrelation function appeared at multiples of the pitch period. Because these peaks tended to be very close in amplitude, the pitch detector sometimes identified the second or third peak as denoting the pitch period. It was necessary to find a way to recognize such situation and then to force the pitch detector to select the first peak.

To solve this problem, the pitch detector of the present invention keeps track of the times of occurrence of both the highest and the second-highest peaks in the autocorrelation function. If these peaks are within a certain percentage difference in amplitude (e.g., 95%), the ratio of the time position (IPITCH2) of the second-highest peak to the time position (IPITCH) of the highest peak is checked to determine if that ratio is $\frac{1}{3}$, $\frac{1}{2}$, or $\frac{2}{3}$, within a predetermined error limit $\epsilon$. If it is, and the ratio is either $\frac{1}{2}$ or $\frac{1}{3}$, then IPITCH is set equal to IPITCH2 as representative of the pitch period while, if the ratio is $\frac{2}{3}$, IPITCH is divided by three in order to represent the pitch period.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawing(s) in which:

DETAILED DESCRIPTION OF A PREFERRED EMBODIMENT OF THE INVENTION

Figure 1:
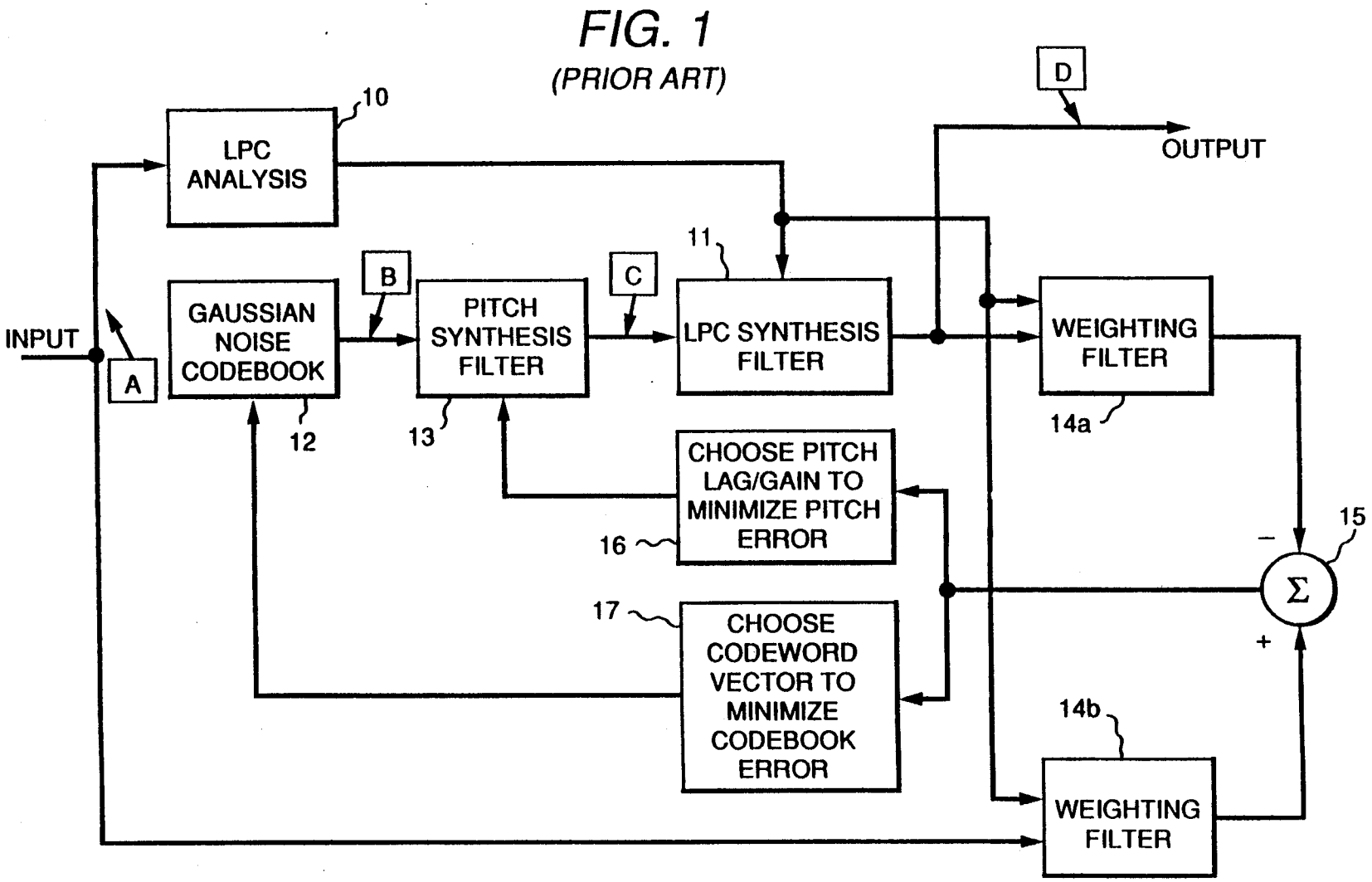
FIG. 1 (PRIOR ART)
FIG. 1 is block diagram showing a known implementation of the basic CELP technique.
Figure 2:
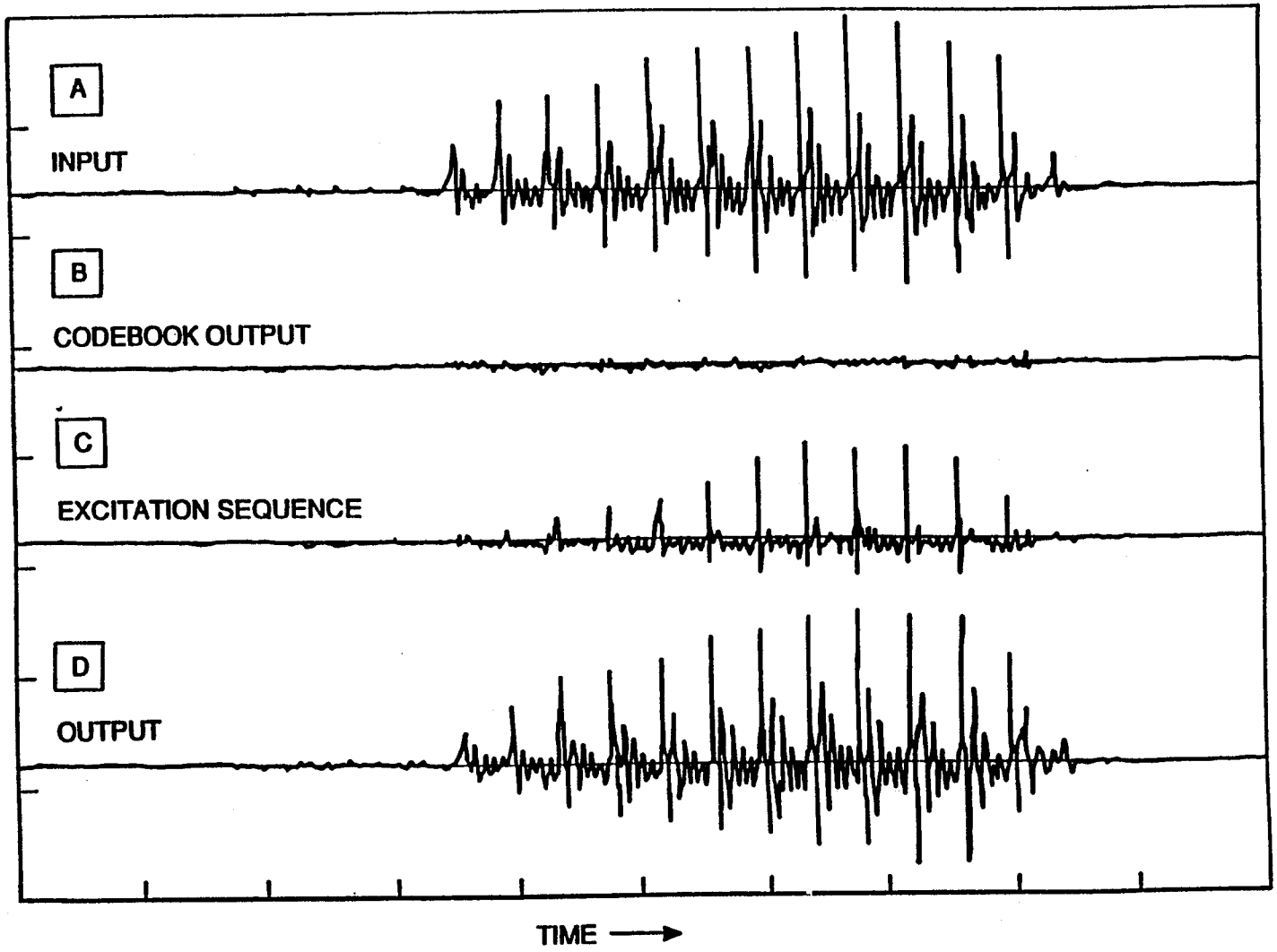
FIG. 2 (PRIOR ART)
FIG. 2 is a graphical representation of signals at various points in the circuit of FIG. 1, illustrating operation of that circuit.

With reference to the known implementation of the basic CELP technique, represented by FIGS. 1 and 2, the input signal at "A" in FIG. 1, and shown as waveform "A" in FIG. 2, is first analyzed in a linear predictive coding analysis circuit 10 so as to produce a set of linear prediction filter coefficients. These coefficients, when used in an all-pole LPC synthesis filter 11, produce a filter transfer function that closely resembles the gross spectral shape of the input signal. Thus the linear prediction filter coefficients and parameters representing the excitation sequence comprise the coded speech which is transmitted to a receiving station (not shown). Transmission is typically accomplished via multiplexer and modem to a communications link which may be wired or wireless. Reception from the communications link is accomplished through a corresponding modem and demultiplexer to derive the linear prediction filter coefficients and excitation sequence which are provided to a matching linear predictive synthesis filter to synthesize the output waveform "D" that closely resembles the original speech.

Linear predictive synthesis filter 11 is part of the subsystem used to generate excitation sequence "C". More particularly, a Gaussian noise codebook 12 is searched to produce an output signal "B" that is passed through a pitch synthesis filter 13 that generates excitation sequence "C". A pair of weighting filters 14*a* and 14*b* each receive the linear prediction coefficients from LPC analysis circuit 10. Filter 14*a* also receives the output signal of LPC synthesis filter 11 (i.e., waveform "D"), and filter 14*b* also receives the input speech signal (i.e., waveform "A"). The difference between the output signals of filters 14*a* and 14*b* is generated in a summer 15 to form an error signal. This error signal is supplied to a pitch error minimizer 16 and a codebook error minimizer 17.

A first feedback loop formed by pitch synthesis filter 13, LPC synthesis filter 11, weighting filters 14*a* and 14*b*, and codebook error minimizer 17 exhaustively searches the Gaussian codebook to select the output signal that will best minimize the error from summer 15. In addition, a second feedback loop formed by LPC synthesis filter 11, weighting filters 14*a* and 14*b*, and pitch error minimizer 16 has the task of generating a pitch lag and gain for pitch synthesis filter 13, which also minimizes the error from summer 15. Thus the purpose of the feedback loops is to produce a waveform at point "C" which causes LPC synthesis filter 11 to ultimately produce an output waveform at point "D" that closely resembles the waveform at point "A". This is accomplished by using codebook error minimizer 17 to choose the codeword vector and a scaling factor (or gain) for the codeword vector, and by using pitch error minimizer 16 to choose the pitch synthesis filter lag parameter and the pitch synthesis filter gain parameter, thereby minimizing the perceptually weighted difference (or error) between the candidate output sequence and the input sequence. Each of codebook error minimizer 17 and pitch error minimizer 16 is implemented by a respective minimum mean square error estimator (MMSE). Perceptual weighting is provided by weighting filters 14*a* and 14*b*. The transfer function of these filters is derived from the LPC filter coefficients. See, for example, the above cited article by B. S. Atal and J. R. Remde for a complete description of the method.

Figure 3:
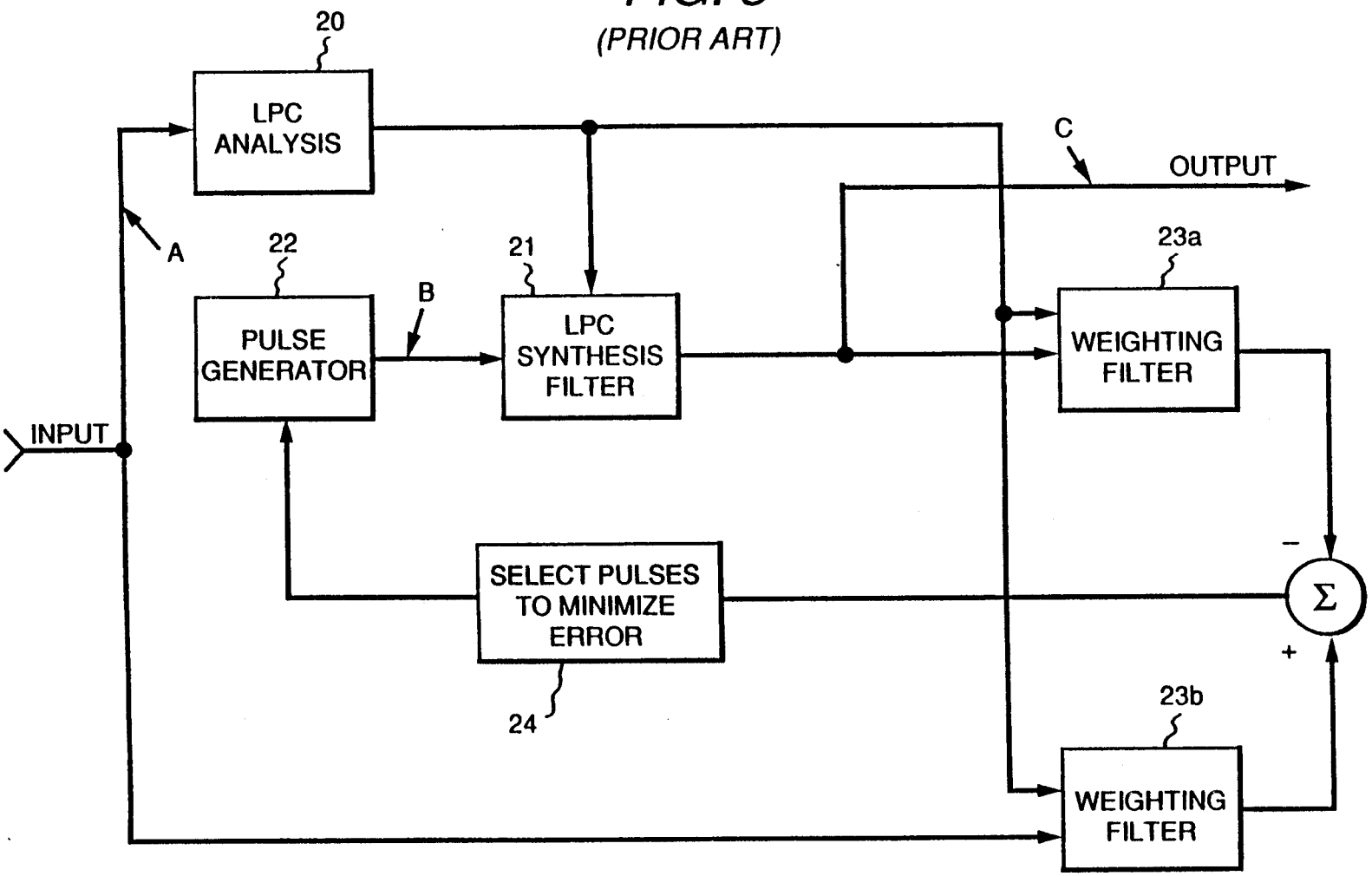
FIG. 3 (PRIOR ART)
FIG. 3 is a block diagram showing implementation of the basic multi-pulse technique for exciting the speech synthesis filter of a standard voice coder.
Figure 4:
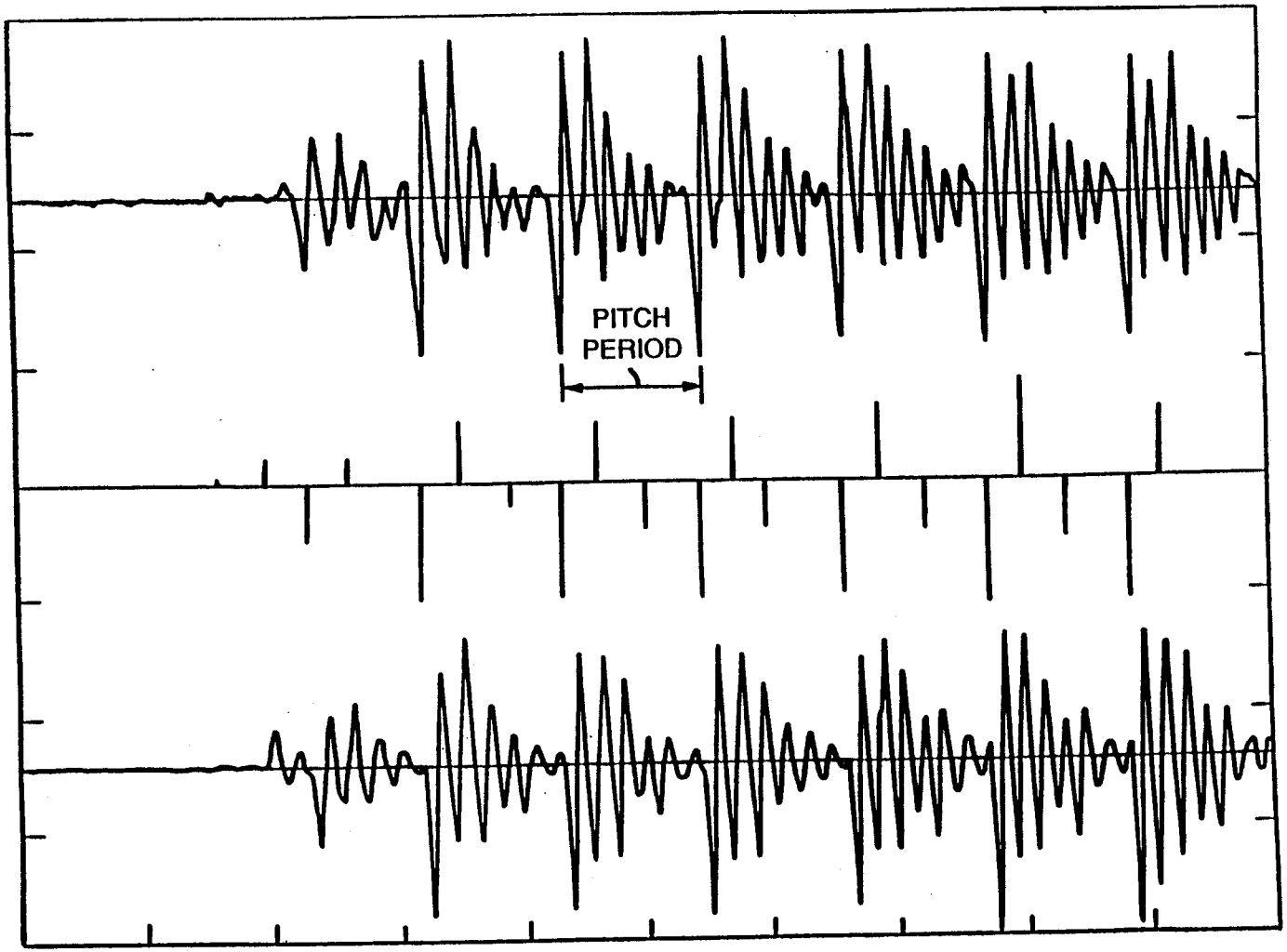
FIG. 4 (PRIOR ART)
FIG. 4 is a graph showing, respectively, the input signal, the excitation signal and the output signal in the system shown in FIG. 3.

In employing the basic multi-pulse technique, as shown in FIG. 3, the input signal at "A" (shown in FIG. 4) is first analyzed in a linear predictive coding analysis circuit 20 to produce a set of linear prediction filter coefficients. These coefficients, when used in an all-pole LPC synthesis filter 21, produce a filter transfer function that closely resembles the gross spectral shape of the input signal. A feedback loop formed by a pulse generator 22, synthesis filter 21, weighting filters 23*a* and 23*b*, and an error minimizer 24 generates a pulsed excitation at point "B" that, when fed into filter 21, produces an output waveform at point "C" that closely resembles the waveform at point "A". This is accomplished by choosing the pulse positions and amplitudes to minimize the perceptually weighted difference between the candidate output sequence and the input sequence. Trace "B" in FIG. 4 depicts the pulse excitation for filter 21, and trace "C" shows the output signal of the system. The resemblance of signals at input "A" and output "C" should be noted. Perceptual weighting is provided by the weighting filters 23*a* and 23*b*. The transfer function of these filters is derived from the LPC filter coefficients. A more complete understanding of the basic multi-pulse technique may be gained from the aforementioned Atal et al. paper.

The linear predictive codeword excited synthesizer (LPCES) according to the invention employs codebook stored "residual" waveforms. Unlike the LPC-10 encoder, which uses a single impulse to excite the synthesis filter during voiced speech, the LPCES uses an entry selected from its codebook. Because the codebook excitation gives a more accurate representation of the actual prediction residual, the quality of the output signal is improved. LPCES models unvoiced speech in the same manner as the LPC-10, with white noise.

Figure 5:
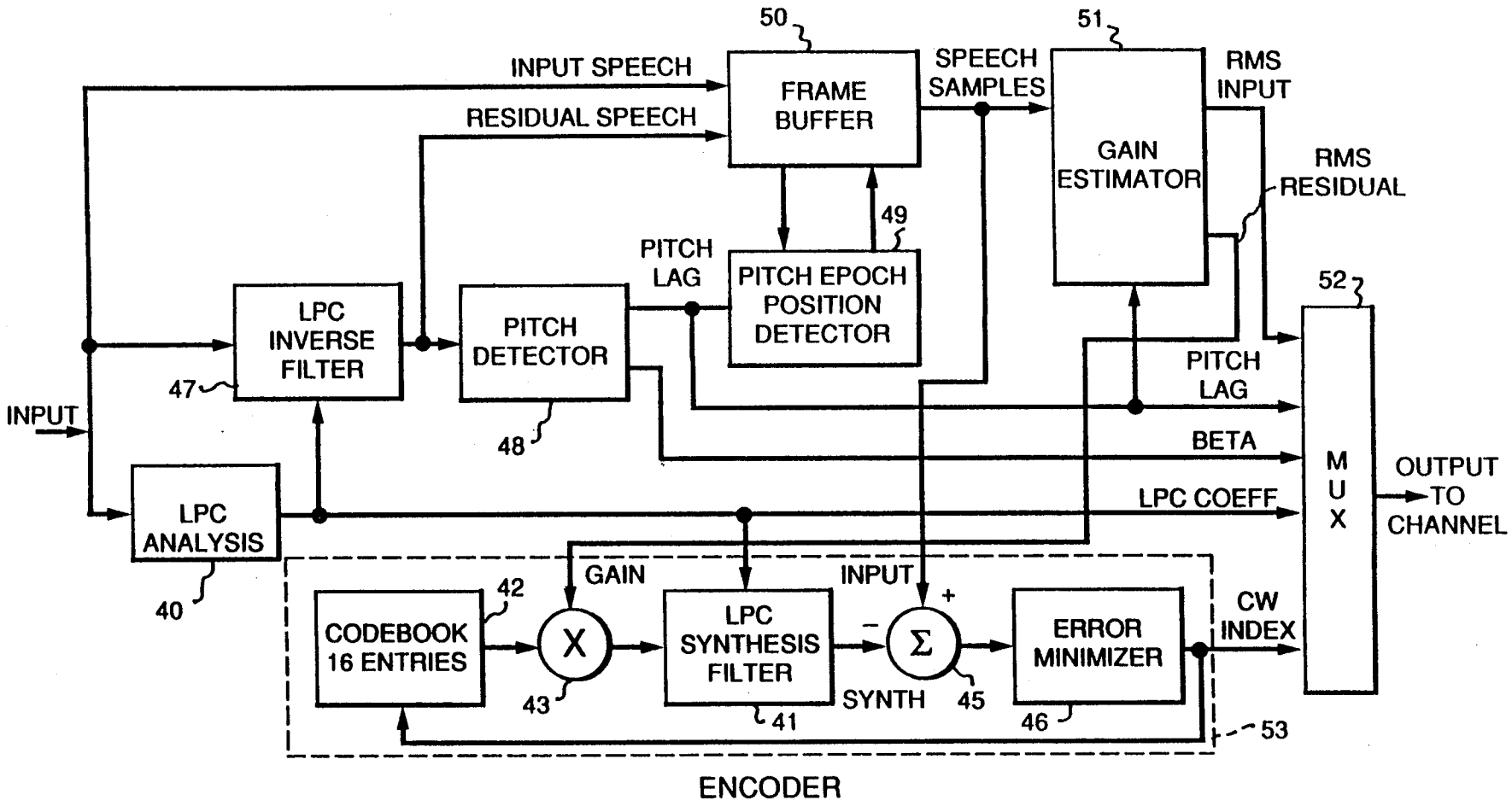
FIG. 5 is a block diagram showing the basic encoder implementing the LPCES algorithm according to the present invention.

FIG. 5 illustrates, in block diagram form, the LPCES encoder used in implementing the present invention and described in application Ser. No. 07/612,056. As in the CELP and multipulse techniques described above, the input signal is first analyzed in a linear predictive coding (LPC) analysis circuit 40. This is a standard unit that uses first order pre-emphasis (pre-emphasis coefficient is 0.85), an input Hamming window, autocorrelation analysis, and Durbin's Algorithm to solve for the linear prediction coefficients. These coefficients are supplied to an all-pole LPC synthesis filter 41 to produce a filter transfer function that closely resembles the gross spectral shape of the input signal. A codebook 42 is searched to produce a signal which is multiplied in a multiplier 43 by a gain factor to produce an excitation sequence input signal to LPC synthesis filter 41. The output signal of filter 41 is subtracted in a summer 45 from a speech samples input signal to produce an error signal that is supplied to an error minimizer 46. The output signal of error minimizer 46 is a codeword (CW) index that is fed back to codebook 42. The combination comprising LPC synthesis filter 41, codebook 42, multiplier 43, summer 45, and error minimizer 46 constitute a codeword selector 53.

Codebook 42 is comprised of vectors that are 120 samples long. It might typically contain sixteen vectors, fifteen derived from actual speech LPC residual sequences, with the remaining vector comprising a single impulse. Because the vectors are 120 samples long, the system is capable of accommodating speakers with pitch frequencies as low as 66.6 Hz, given an 8 kHz sampling rate.

For voiced speech, a new excitation codeword is chosen at the start of each frame, in synchronism with the output pitch period. Only the first P samples of the selected vector are used as excitation, with P indicating the fundamental (pitch) period of the input speech.

The input signal is also supplied to an LPC inverse filter 47 which receives the LPC coefficient output signal from LPC analysis circuit 40. The output signal of the LPC inverse filter is supplied to a pitch detector 48 which generates both a pitch lag output signal and a pitch autocorrelation ($\beta$) output signal. The use of LPC inverse filter 47 is a standard technique which requires no further description for those skilled in the art. Pitch detector 48 performs a standard autocorrelation function, but provides the first-order normalized autocorrelation of the pitch lag ($\beta$) as an output signal. The autocorrelation $\beta$ (also called the "pitch tap gain") is used in the voiced/unvoiced decision and in the decoder's codeword excited synthesizer. For best performance, the input signal to pitch detector 48 from LPC inverse filter 47 should be lowpass filtered (800–1000 Hz cutoff frequency).

The input speech signal and LPC residual speech signal (from filter 47) are supplied to a frame buffer 50. Buffer 50 stores the samples of these signals in two arrays (one for the input speech and one for the residual speech) for use by a pitch epoch position detector 49. The function of the pitch epoch position detector is to find the point where the maximum excitation of the speaker's vocal tract occurs over a pitch cycle. This point acts as a fixed reference within a pitch period that is used as an anchor in the codebook search process and is also used in the initial generation of the codebook entries. The anchor represents the definite point in time in the incoming speech to be matched against the first sample in each codeword. Epoch detector 49 is based on a peak picker operating on the stored input and residual speech signals in buffer 50. The algorithm works as follows: First, the maximum amplitude (absolute value) point in the input speech frame (location $PMAX_{in}$) is found. Second, a search is made between $PMAX_{in}$ and $PMAX_{in}-15$ for an amplitude peak in the residual; this is $PMAX_{res}$. $PMAX_{res}$ is used as a standard anchor point within a given frame.

The output signal of frame buffer 50 is made up of segments of the input and residual speech signals beginning slightly before the standard anchor point and lasting for just over one pitch period. These input speech sample segments and residual speech sample segments, along with the pitch period (from pitch detector 48), are provided to a gain estimator 51. The gain estimator calculates the gain of the speech input signal and of the LPC speech residual by computing the root-mean-square (RMS) energy for one pitch period of the input and residual speech signals, respectively. The RMS residual speech gain from estimator 51 is applied to multiplier 43 in the codeword selector, while the input speech gain, the pitch and $\beta$ signals from pitch detector 48, the LPC coefficients from LPC analysis circuit 40 and the CW index from error minimizer 46 are all applied to a multiplexer 52 for transmission to the channel.

To understand how codeword selector 53 operates, consideration must first be given to how a codebook is constructed for the LPCES algorithm. To create a codebook, "typical" input speech segments are analyzed with the same pitch epoch detection technique given above to determine the $PMAX_{res}$ anchor point. Codewords are added to a prospective codebook by windowing out one pitch period of source speech material between the points located at $PMAX_{res}-4$ and $PMAX_{res}-4+P$, where P is the pitch period. The P samples are placed in the first P locations of a codeword vector, with the remaining 120−P locations filled with zeros. During actual operation of the LPCES coder, $PMAX_{res}$ is passed directly to the next stage of the algorithm. This stage selects the codeword to be used in the output synthesis.

The codeword selector chooses the excitation vector to be used in the output signal of the LPC synthesizer. It accomplishes this by comparing one pitch period of the input speech in the vicinity of the $PMAX_{res}$ anchor point to one pitch period of the synthetic output speech corresponding to each codeword. The entire codebook is exhaustively searched for the filtered codeword comparing most favorably with the input signal. Thus each codeword in the codebook must be run through LPC synthesis filter 41 for each frame that is processed. Although this operation is similar to what is required in the CELP coder, the computational operations for LPCES are about an order of magnitude less complex because (1) the codebook size for reasonable operation is only twelve to sixteen entries, and (2) only one pitch period per frame of synthesis filtering is required. In addition, the initial conditions in synthesis filter 41 must be set from the last pitch period of the last frame to ensure correct operation.

A comparison operation is performed by aligning one pitch period of the codeword-excited synthetic output speech signal with one pitch period of the input speech near the anchor point. The mean-square difference between these two sequences is then computed for all codewords. The codeword producing the minimum mean-square difference (or MSE) is the one selected for output synthesis. To make the system more versatile and to protect against minor pitch epoch detector errors, the MSE is computed at several different alignment positions near the $PMAX_{res}$ point.

The LPCES voiced/unvoiced decision procedure is similar to that used in LPC-10 encoders, but includes an SNR (signal-to-noise ratio) criterion. Since some codewords might perform very well under unvoiced operation, they are allowed to be used if they result in a close match to the input speech. If SNR is the ratio of codeword RMSE (root-mean-square-error) to input RMS power, then the V/UV (voiced/unvoiced) decision is defined by the following pseudocode:

```
Voiced/Unvoiced_Decision
IUV=O
IF ( ( (ZCN.GT.0.25)
      .AND. (RMSIN.LT.900.0)
      .AND. (BETA.LT.0.95)
```

-continued

```
      .AND. (SNR.LT.2.0) )
      .OR. (RMSIN.LT.50) ) IUV=1
```

where IUV=1 defines unvoiced operation, ZCN is the normalized zero-crossing rate, RMSIN is the input RMS level, and BETA is the pitch tap gain.

The codeword-excited LPC synthesizer is quite similar to the LPC-10 synthesizer, except that the codebook is used as an excitation source (instead of single impulses). The P samples of the selected codeword are repeatedly played out, creating a synthetic voiced output signal that has the correct fundamental frequency. The codeword selection is updated, or allowed to change, once per frame. Occasionally, the codeword selection algorithm may choose a word that causes an abrupt change in the excitation waveform at the end of a pitch period just after a frame boundary. The "correct" periodicity of the excitation waveform is ensured by forcing period-to-period changes in the excitation to occur no faster than the pitch tap gain would suggest. In other words, the excitation waveform e(i) is given by the following equation:

$$e(i)=\beta e(i-P)+(1-\beta)code(i,index), \quad (1)$$

where $\beta$ is the pitch tap gain (limited to 1.0), P is the pitch period, and code (i,index) is the $i^{th}$ sample of codeword number index. This method of enforcing periodicity is known as the "$\beta$-lock" technique. To complete the synthesis operation, the sequence of equation (1) is filtered through the LPC synthesis filter and de-emphasized.

For transmission, the LPC coefficients are converted to reflection coefficients (or partial correlation coefficients, known as PARCORs) which are linearly quantized, with maximum amplitude limiting on RC(3)–RC(10) for better quantization acuity and artifact control during bit errors. ("RC", as used herein, stands for "reflection coefficient"). For this system, the RCs are quantized after the codeword selection algorithm is finished, to minimize unnecessary codeword switching. In addition, a switched differential encoding algorithm is used to provide up to three bits of extra acuity for all coefficients during sustained voiced phonemes. The other transmitted values are pitch period, filter gain, pitch tap gain, and codeword index. The bit allocations for all parameters are shown in the following table.

| | |
|---|---|
| LPC Coefficients | 48 bits |
| Pitch | 6 bits |
| Pitch Tap Gain | 6 bits |
| Gain | 8 bits |
| Codeword Index (includes V/UV) | 4 bits |
| Differential Quantization Selector | 2 bits |
| Total | 74 bits |
| Frame Rate (128 samples/frame) | 62.5 frame/sec. |
| Output Rate | 4625 bits/sec. |

Figure 6:
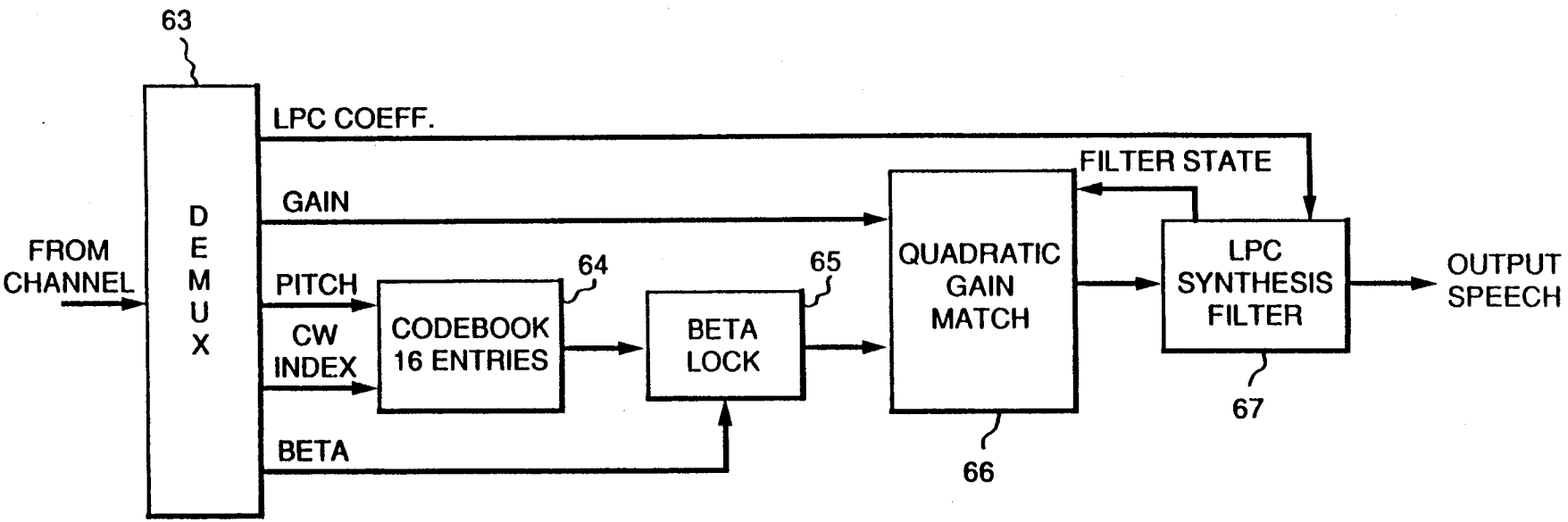
FIG. 6 is a block diagram showing the basic decoder implementing the LPCES algorithm according to the present invention.

As shown in FIG. 6, which represents the LPCES decoder used in implementing the present invention and described in application Ser. No. 07/612,656, the signal from the channel is applied to a demultiplexer 63 which separates the LPC coefficients, the gain, the pitch, the CW index, and the beta signals. The pitch and CW index signals are applied to a codebook 64 having sixteen entries. The output signal of codebook 64 is a codeword corresponding to the codeword selected in the encoder. This codeword is applied to a beta lock 65 which receives as its other input signal the signal. Beta lock 65 enforces the correct periodicity in the excitation signal by employing the method of equation (1), above. The output signal of beta lock 65 and the gain signal are applied to a quadratic gain match circuit 66, the output signal of which, together with the LPC coefficients, is applied to an LPC synthesis filter 67 to generate the output speech. The filter state of LPC synthesis filter 67 is fed back to the quadratic gain match circuit to control that circuit.

The quadratic gain match system 66 solves for the correct excitation scaling factor (gain) and applies it to the excitation signal The output gain ($G_{out}$) can be estimated by solving the following quadratic equation:

$$E_z+2G_{out}C_{ze}+G^2_{out}E_e=E_i. \quad (2)$$

where $E_z$ is the energy of the output signal due to the initial state in the synthesis filter (i.e., the energy of the zero-input response), $C_{ze}$ is the cross-correlation between the output signal due to the initial state in the filter and the output signal due to the excitation (or $C_{ze}$ may be defined as the correlation between the zero-input response and the zero-state response), $E_e$ is the energy due to the excitation only (i.e., the energy of the zero-state response), and $E_i$ is the energy of the input signal (i.e., the transmitted gain for demultiplexer 63). The positive root (for $G_{out}$) of equation (2) is the output gain value. Application of the familiar quadratic equation formula is the preferred method for solution.

The LPCES algorithm has been fully quantized at a rate of 4625 bits per second. It is implemented in floating point FORTRAN. Comparative measurements were made of the CPU (central processor unit) time required for LPC-10, LPCES and CELP. The results and test conditions are given below.

| CPU Time Test Conditions | |
|---|---|
| LPC-10: | 10-th order LPC model, ACF pitch detector |
| LPCES-14: | 10-th order LPC model, 14 × (variable) codebook |
| CELP-16: | 10-th order LPC model, 16 × 40 codebook, 1 tap pitch predictor |
| CELP-1024: | 10-th order LPC model, 1024 × 40 codebook, 1 tap pitch predictor |

| Normalized CPU Time to Process 1280 Samples LPC-10 = 1 unit | | | |
|---|---|---|---|
| LPC-10 | LPCES-1 | CELP-16 | CELP-1024 |
| 1.0 | 4.4 | 13.2 | 102.3 |

Figure 7:
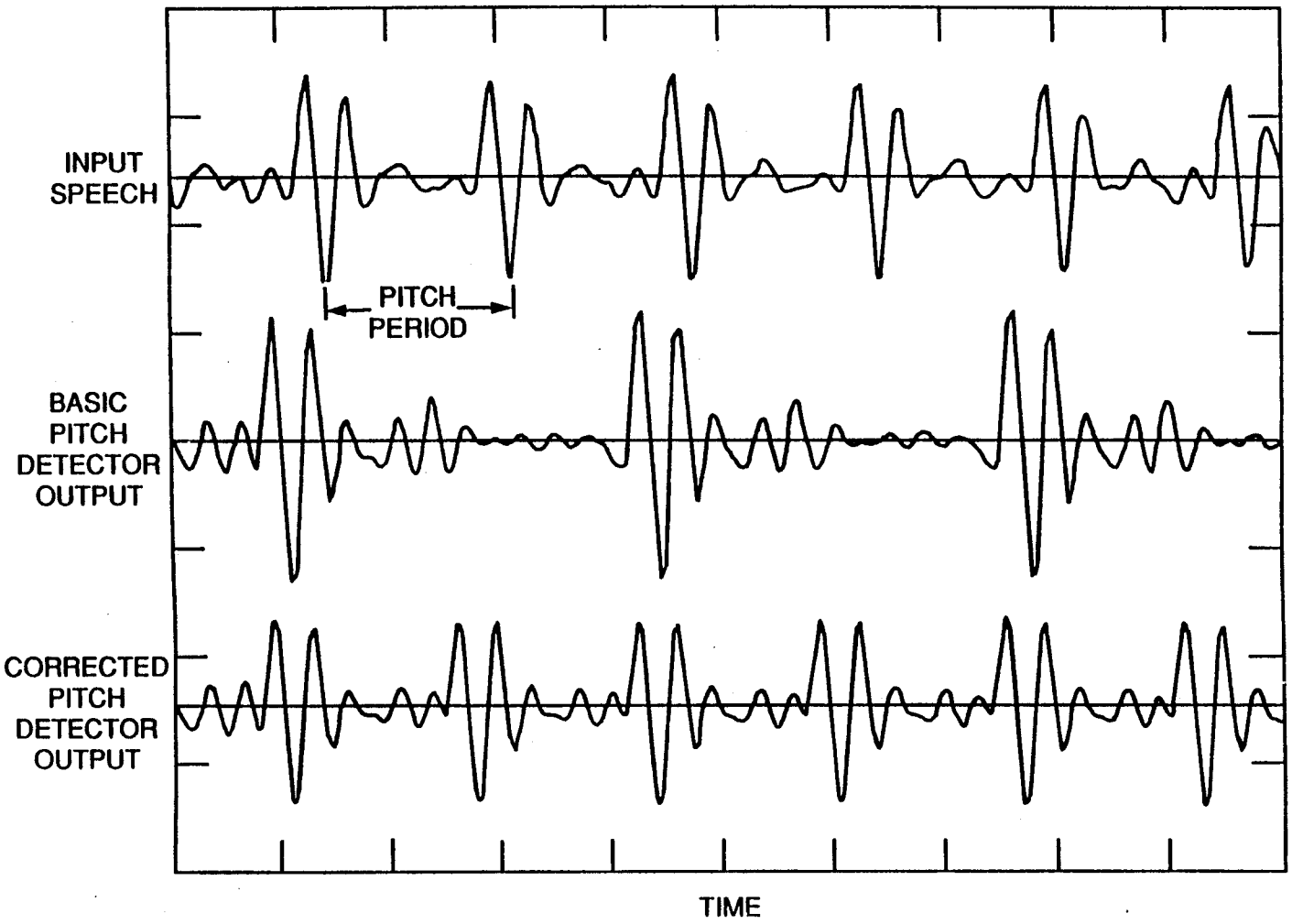
FIG. 7 is a graph showing sample speech waveforms with and without the improved pitch detection method of the invention.
Figure 8:
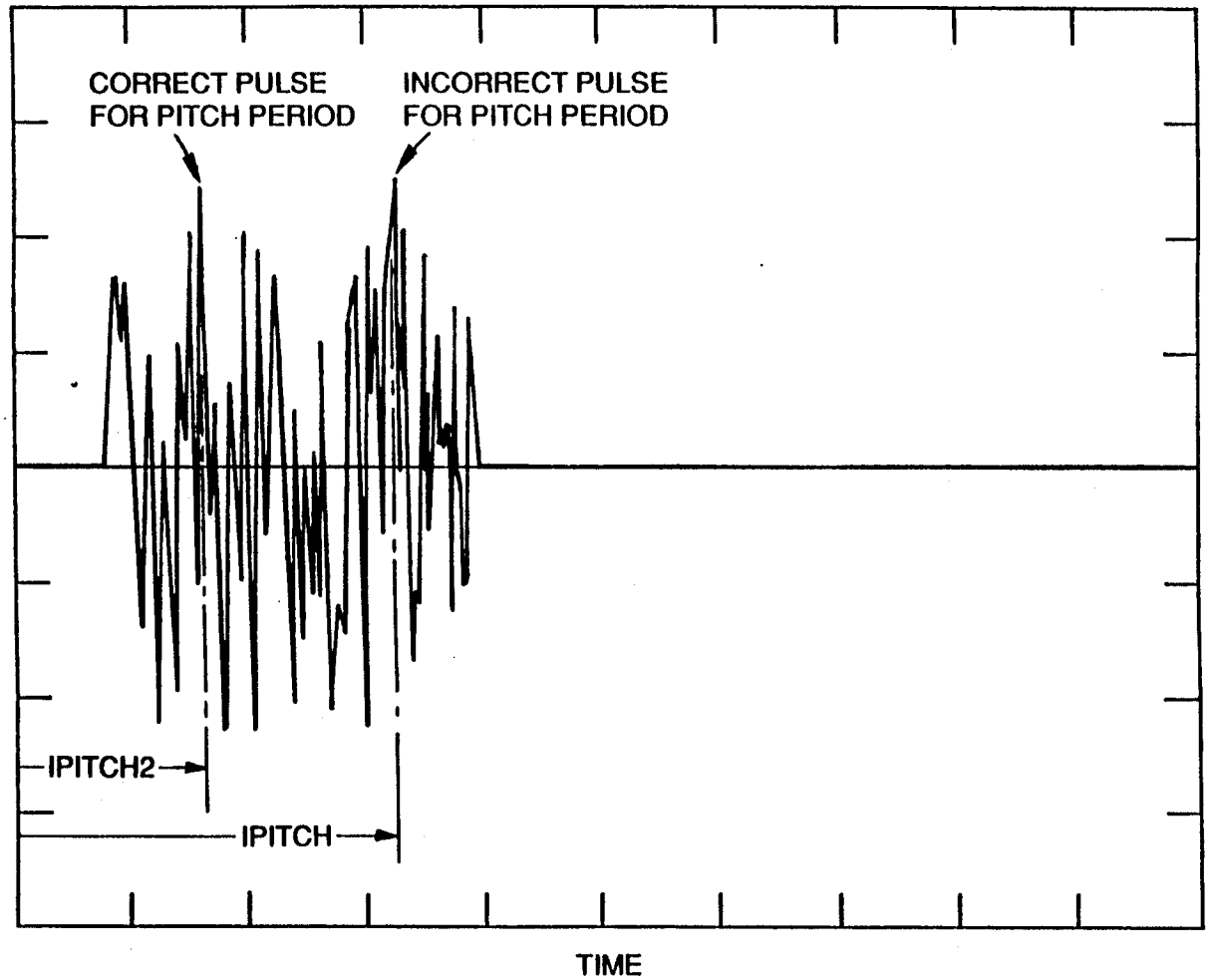
FIG. 8 is a graph showing the autocorrelation output signal for the input speech waveform shown in FIG. 7.

The present invention is specifically directed to an improvement in the pitch detector for the LPCES coder and decoder shown in FIGS. 5 and 6, respectively. FIG. 7, which illustrates the problem that is solved by the invention, shows three waveforms: an input speech waveform, a speech coder output waveform where the pitch period has been doubled due to erroneous operation of the pitch detector, and a speech coder output waveform with a corrected pitch period, as produced by the present invention. FIG. 8 shows the result of the autocorrelation operation for the same segment of speech. This input speech signal shown in FIG. 8 contains two peaks of similar amplitude a pitch period apart. Selection of the slightly higher amplitude peak is what gives rise to the pitch period doubling effect shown in the second waveform of FIG. 7.

Figure 9:
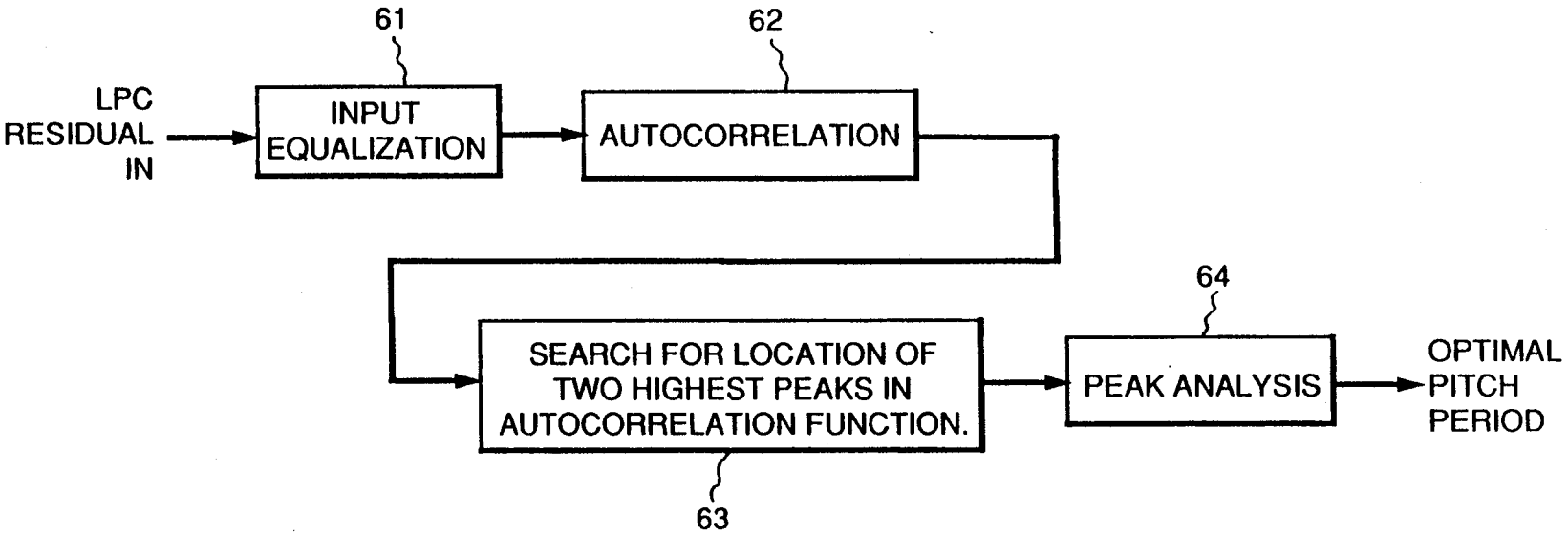
FIG. 9 is a block diagram showing the basic components of the improved pitch detector according to the present invention.

The improved autocorrelation pitch detector is illustrated in the block diagram of FIG. 9. The LPC residual input speech signal is equalized in an input equalization circuit 61 before being applied to an autocorrelator 62. The autocorrelation function is a part of the basic pitch detector and provides the pitch tap gain output signal previously described. In the present invention, the output signal of the autocorrelator is supplied to a first analyzer 63 which searches for the location, on a time axis, of the two highest peaks in the autocorrelation function. These peaks are identified to a second analyzer 64 which performs the peak analysis according to the invention to provide an output signal corresponding to the optimal pitch period.

Figure 10:
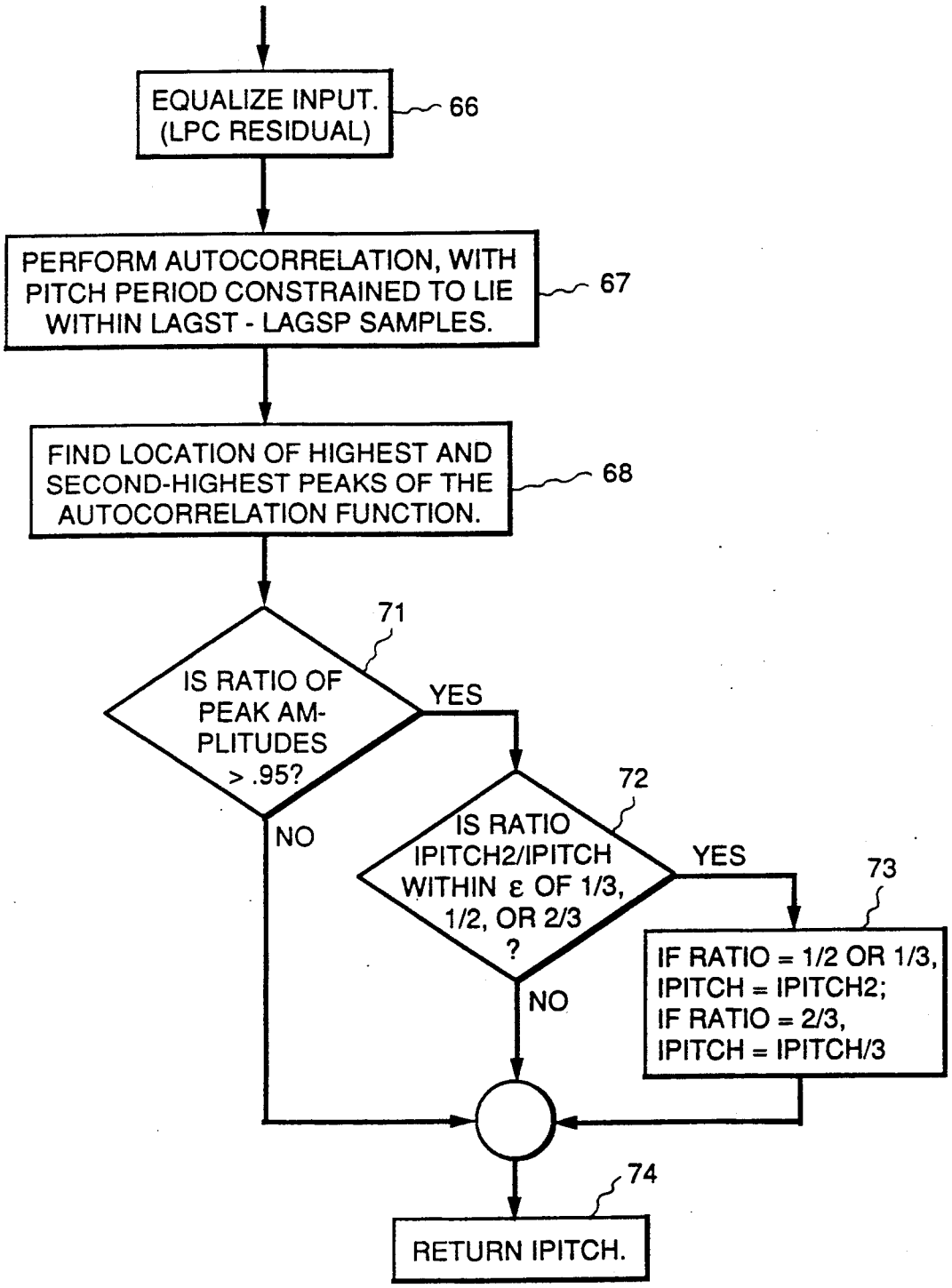
FIG. 10 is a flow chart illustrating the logic of the implementation of the pitch detector algorithm according to the invention.

FIG. 10 is a flow chart showing the logic of the improved autocorrelation pitch detector. The first step in the process is to equalize the input speech signal, as indicated by function block 66. This is followed by performing the autocorrelation operation with the pitch period constrained to lie within a band defined at its lowest (i.e., lag start) frequency by LAGST samples and at its highest (i.e., lag stop) frequency by LAGSP samples as indicated in function block 67. The output signal resulting from the autocorrelation function is then analyzed, as indicated by function block 68, to identify the locations, timewise, of the highest and second-highest peaks. A test of these peaks is made, as indicated by decision block 71, to determine if the ratio of the peak amplitudes of the highest and second-highest peaks is greater than 0.95. If so, a further test is made, as indicated by decision block 72, to determine if the ratio of the pitch period of the second-highest peak (IPITCH2) to the pitch period of the highest peak (IPITCH) is $\frac{1}{3}$, $\frac{1}{2}$ or $\frac{2}{3}$, within a predetermined error limit $\epsilon$. If so, then if the ratio is either $\frac{1}{2}$ or $\frac{1}{3}$, IPITCH is set equal to IPITCH2 as representative of the pitch period while, if the ratio is $\frac{2}{3}$, then IPITCH is divided by three, as indicated by function block 73 so as to restore the correct pitch period at the output of the pitch detector, as indicated by function block 74. Of course, if the tests in either of decision blocks 71 or 72 are negative, the pitch period of the highest peak is restored at the output of the pitch detector.

While only certain preferred features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A method of operating an autocorrelation pitch detector for use in a vocoder comprising the steps of:

tracking times of occurrence of a highest and a second-highest autocorrelation peak in an input signal;

comparing amplitudes of said highest and second-highest autocorrelation peaks;

identifying said times of occurrence to determine if the time position of said highest autocorrelation peak and the time position of said second-highest autocorrelation peak are in a predetermined ratio when said highest and second-highest autocorrelation peaks are within a predetermined percentage difference in amplitude; and selecting as a true autocorrelation peak one of said highest or second-highest autocorrelation peaks when said predetermined ratio exists between said time position of said highest autocorrelation peak and said time position of said second-highest autocorrelation peak.

2. The method of operating an autocorrelation pitch detector as recited in claim 1 wherein said predetermined ratio is approximately 2:1 or 3:1.

3. The method of operating an autocorrelation pitch detector as recited in claim 1 further comprising the steps of:

checking said times of occurrence to determine if the time position of said highest autocorrelation peak and the time position of said second-highest autocorrelation peak are in a ratio of approximately 3:2 when said highest and second-highest autocorrelation peaks are within said predetermined percentage difference in amplitude; and dividing said time position of said highest autocorrelation peak by three when said 3:2 ratio exists to provide a resulting output signal representing true pitch period.

4. The method of operating an autocorrelation pitch detector as recited in claim 2 further comprising the steps of:

checking said times of occurrence to determine if the ratio of the time position of said highest autocorrelation peak to the time position of said second-highest autocorrelation peak is approximately 3:2 when said highest and second-highest autocorrelation peaks are within said predetermined percentage difference in amplitude; and dividing said time position of said highest autocorrelation peak by three when said 3:2 ratio exists to provide a resulting output signal representing true pitch period.

5. The method of operating an autocorrelation pitch detector as recited in claim 2 further comprising the step of selecting as a true autocorrelation peak one of said highest autocorrelation peaks whenever the ratio of the time position of said highest autocorrelation peak to the time position of said second-highest autocorrelation peak is other than 2:1, 3:1 or 3:2.

6. A method of operating an autocorrelation pitch detector for use in a vocoder comprising the steps of:

tracking times of occurrence of a highest and a second-highest autocorrelation peak in an input signal;

comparing amplitudes of said highest and second-highest autocorrelation peaks;

checking said times of occurrence to determine if the ratio of the time position of said highest autocorrelation peak to the time position of said second-highest autocorrelation peak is approximately 3:2 when said highest and second-highest autocorrelation peaks are within said predetermined percentage difference in amplitude; and dividing said time position of said highest autocorrelation peak by three when said 3:2 ratio exists to provide a resulting output signal representing true pitch period.

7. An autocorrelation pitch detector for use in a vocoder comprising:

autocorrelation means for autocorrelating an input signal and generating an output signal having a plurality of peaks;

first analyzer means for tracking times of occurrence of a highest and a second-highest autocorrelation peak from said autocorrelation means; and second analyzer means responsive to said first analyzer means for comparing amplitudes of said highest and second-highest autocorrelation peaks, checking said positions to determine if the ratio of the time position of said highest autocorrelation peak to the time position of said second-highest autocorrelation peak is approximately 2:1 or 3:1 when said highest and second-highest autocorrelation peaks are within a predetermined percentage difference in amplitude, and selecting as a true autocorrelation peak one of said highest or second-highest autocorrelation peaks when said approximately 2:1 or 3:1 ratio exists between said time position of said highest autocorrelation peak and said time position of said second-highest autocorrelation peak.

8. An autocorrelation pitch detector for use in a vocoder comprising:

autocorrelation means for autocorrelating an input signal and generating an output signal having a plurality of peaks;

first analyzer means for tracking times of occurrence of a highest and a second-highest autocorrelation peak from said autocorrelation means; and second analyzer means responsive to said first analyzer means for comparing amplitudes of said highest and second-highest autocorrelation peaks, checking said positions to determine if the ratio of the time position of said highest autocorrelation peak to the time position of said second-highest autocorrelation peak is approximately 3:2 when said highest and second-highest autocorrelation peaks are within said predetermined percentage difference in amplitude, and dividing said time position of said highest autocorrelation peak by three when said 3:2 ratio exists to provide a resulting output signal representing true pitch period.

* * * * *